United States Patent [19]

de Vries

[11] Patent Number: 4,587,515

[45] Date of Patent: May 6, 1986

[54] SUPERVISING ARRANGEMENT

[75] Inventor: Coos de Vries, Hilversum, Netherlands

[73] Assignee: U.S. Philips Corporation, New York, N.Y.

[21] Appl. No.: 491,850

[22] Filed: May 5, 1983

[30] Foreign Application Priority Data

May 10, 1982 [NL] Netherlands ..... 8201901

[51] Int. Cl.[4] ..... G08B 29/00

[52] U.S. Cl. ..... 340/506; 340/500; 340/517; 340/525

[58] Field of Search ..... 340/506, 500, 514, 515, 340/517, 520, 521, 524, 525, 529, 825.06, 825.17

[56] References Cited

U.S. PATENT DOCUMENTS 4,117,479 9/1978 Galvin et al. ..... 340/506

FOREIGN PATENT DOCUMENTS 1921757 4/1969 Fed. Rep. of Germany .

*Primary Examiner*—Donnie L. Crosland

*Attorney, Agent, or Firm*—Thomas A. Briody; William J. Streeter; Edward W. Goodman

[57] ABSTRACT

A supervising arrangement for a transmission system, having an alarm system which displays alarm signals from different apparatus by indication lamps. All the indication lamps which are lit are extinguished by operation of a central key to effect alarm suppression. The indication lamps of still existing alarms light up and go dark again after further operation and release of the key.

5 Claims, 2 Drawing Figures

SUPERVISING ARRANGEMENT

BACKGROUND OF THE INVENTION

The invention relates to a supervising arrangement for equipment in a station in the form of a transmission network, the arrangement comprising an alarm system which is responsive to alarm signals occurring in the equipment, different alarm signals from different apparatus being displayed by means of indication lamps for each of the possible alarm signals, and energizing circuits for the indication lamps being controllable by means of a central key with which also, after reception of an alarm signal, the alarm system can be released again for the reception of a subsequent alarm signal.

In a transmission network, alarms which may occur can result in the restoration of the traffic not being effected rapidly, because a fault causing an alarm does not actually occur in the station where the alarm is reported. In order to release the alarm system in the station to enable the detection of new alarms, it must be possible for a subsisting alarm to be suppressed. This can be effected by means of a central key.

Such an arrangement is disclosed in, for example, German Auslegeschrift 1.921.757, in which the indication lamps are arranged in such a way that alarm signal lamps form the abscissa and location indicating lamps form the ordinates of a system of coordinates, the location indicating lamps being controlled via a circuit such that, at the beginning of an alarm condition, the relevant lamps start flashing, while after the central key has been depressed, these lamps remain lit steadily. After the alarm condition has been eliminated, the lamps start flashing again and the lamps go dark after the central key has been depressed.

This prior art supervising arrangement has the drawback that after suppression of an alarm signal the relevant indication lamps remain lit, which consumes much power. In addition, this prior art arrangement has the disadvantage that when several systems give an alarm one after the other, a logging unit is required to check which alarm signal was received last. It is furthermore necessary, after elimination of an alarm condition, to turn-off the then flashing indication lamp by operating the central key. If an unmanned station is concerned, a special visit to the unmanned station is necessary for this purpose.

SUMMARY OF THE INVENTION

The invention has for its object to provide a supervising arrangement of the above type, which does not have the above-mentioned disadvantages.

According to the invention, a supervising arrangement of the above type is characterized in that the alarm system comprises switching means by means of which all the indication lamps which are lit are extinguished after operating and releasing the central key and by means of which, when the central key is operated, those indication lamps which correspond to subsisting alarms are lit again during the period of time the central key remains operated.

The measures in accordance with the invention achieve that only when alarms are received the indication lamps are lit continuously. After operating and releasing the central key all the indication lamps are switched off. Thereafter when the central key is operated, only those indication lamps which correspond to still existing alarms will be lit again. When the central key is released again all the indication lamps go dark again. This results in an enormous saving in the power consumed by the indication lamps.

In addition, the measures in accordance with the invention accomplish that when an alarm has ended it is not necessary to operate the central key once more, to extinguish the relevant indication lamp, so that if the station where the alarm originated from is unmanned no special visit to that station is required (no restore report).

DESCRIPTION OF THE DRAWING

The invention will now be described in greater detail by way of example with reference to the accompanying drawing of which.

DESCRIPTION OF THE PREFERRED EMBODIMENT

Figure 1:
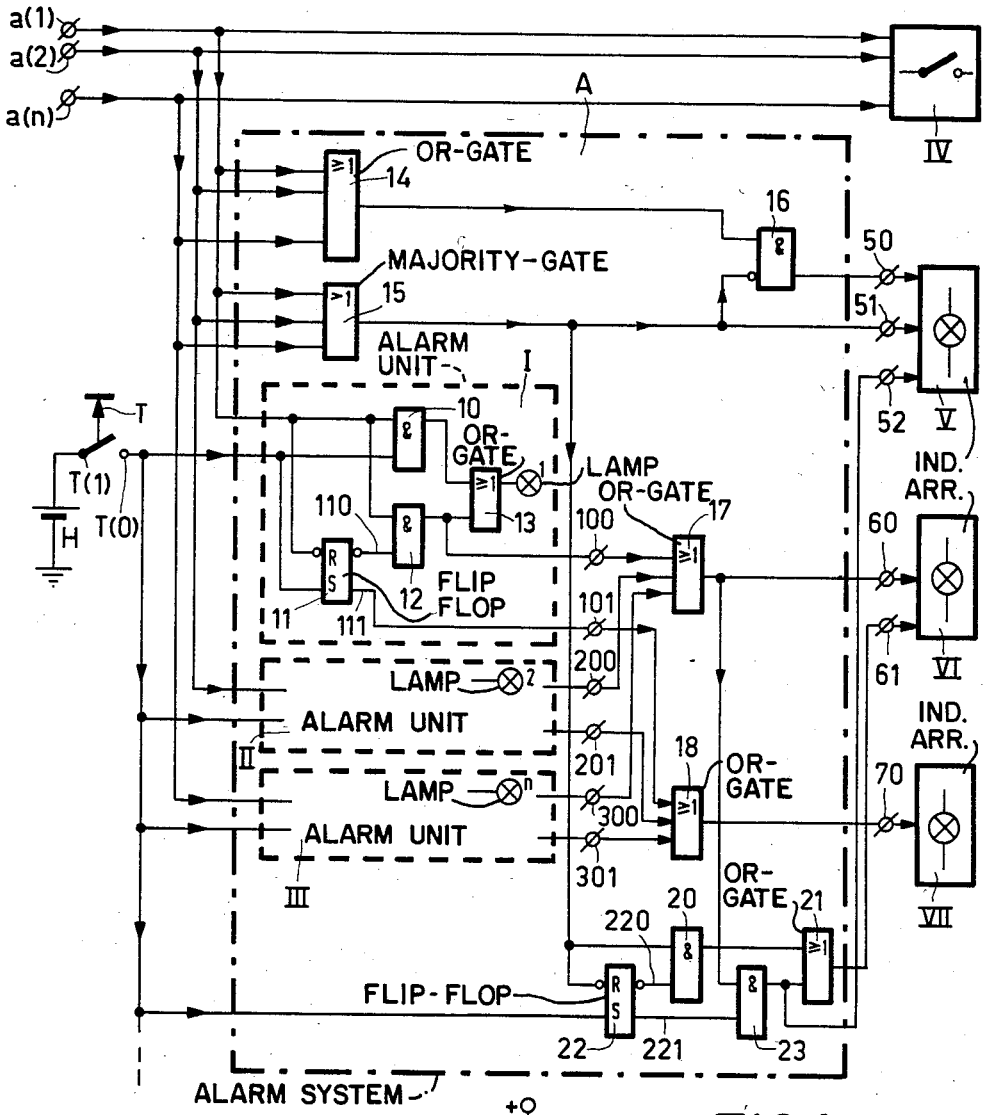
FIG. 1 shows an embodiment of the supervising arrangement in accordance with the invention.

In the supervising arrangement shown in FIG. 1, A denotes the alarm system for equipment in a station which, for example, forms part of a transmission network. Alarm inputs a(1) . . . a(n) of the alarm system A are connected to those points in the station equipment which are to be supervised. The alarm inputs a(1) . . . a(n) are also through-connected to the inputs of a change-over circuit IV, which, when an apparatus of the station equipment becomes defective, ensures that a stand-by apparatus is switched-on. The alarm system A includes alarm units 1111, II and III, which each supervise a portion of the equipment. The alarm input a(1) of the alarm system A is connected to a first input of the alarm unit I. The first input of the unit I is connected to one input of an AND-gate 10, the other input of which is connected to a second input of the alarm unit I. The first input of the unit I is also connected to the reset input (R) of a flip-flop circuit 11. The first input of the unit I and the inverting output 110 of the flip-flop 11 are connected to respective inputs of an AND-gate 12. The output of the AND-gate 10 is connected to one input of an OR-gate 13, the other input of which is connected to the output of the AND-gate 12. The output of the OR-gate 13 is connected to an indication lamp 1, which is associated with the alarm unit I. The output of the AND-gate 12 is also connected to a first output 100 of the alarm unit I. The other output 111 of the flip-flop 11 is connected to a second output 101 of the alarm unit I. The second input of the alarm unit I is connected to one switching contact T(0) of a central key T, whose other switching contact T(1) is connected to a source H of constant potential.

The alarm input a(2) is connected to the first input of the alarm unit II, the second input of which is connected to the switching contact T(0) of the central key T. The alarm input a(n) is connected to the first input of the alarm unit III, the second input of which is connected to the switching contact T(0) of the central key T. The construction of the two alarm units II and III is identical to the construction of the alarm unit I and is not shown in further detail in the Figure.

The first outputs 100, 200 and 300 of the units I, II and III, respectively. are connected to respective inputs of an OR-gate 17. The second outputs 101, 201 and 301 of the alarm units I, II and III are connected to respective inputs of an OR-gate 18. The output of the OR-gate 17 is connected to an input 60 of an indication arrangement VI and also to an input of an AND-gate 23. The output of the OR-gate 18 is connected to an input 70 of an alarm inhibitor indication arrangement VII. The output of the AND-gate 23 is connected to a first input of an OR-gate 21 and also to an input 52 of an arrangement V which pertains to operating and maintenance of the system. The output of the OR-gate 21 is connected to an input 61 of the indication arrangement VI. A second input of OR-gate 21 is connected to the output of an AND-gate 20, a first input of which is connected to the reset input of a flip-flop 22 and a second input of which is connected to the inverting output 220 of the flip-flop 22, while the other output 221 of the flip-flop 22 is connected to the second input of AND-gate 23. The set input S of the flip-flop 22 is connected to the switching contact T(0) of the central key T. The alarm inputs a(1) . . . a(n) are connected to respective inputs of an OR-gate 14, the output of which is connected to a first input of an AND-gate 16. The alarm inputs a(1) . . . a(n) are further connected to respective inputs of a majority gate 15, the output of which is connected to an inverting input of the AND-gate 16. The output of the AND-gate 16 is connected to an input 50 of the indication arrangement V. The output of the gate 15 is also connected to an input 51 of the arrangement V and also to the reset input of the flip-flop 22. For the transfer functions of the units shown in FIG. 1, reference is made to "Electrotechnische symbolen" NEN 5152.

It should be noted that the embodiment shown in FIG. 1 is an example of processing system alarms in combination with suppression, a spare system co-operating with one or a plurality of operative systems, the spare system being able to take over the function of one of the operative systems automatically with the aid of the change-over circuit IV. Since automatic change-over is employed, measures have been taken to prevent the change-over command derived from the alarm commands a(1) . . . a(n) of the different systems from being influenced by the suppression of the alarm. For that purpose, the alarm inputs a(1) . . . a(n) are directly connected to the inputs of the change-over arrangement IV.

It should further be noted that the indication arrangement V is provided in a central station which monitors a plurality of sub-stations and from which it is determined what actions must be taken, in what sequence, and by which maintenance unit, in dependence on various incoming alarms from the different sub-stations.

When no alarm signals are received in the station, a logic 0 is present at all the alarm inputs a(1) . . . a(n). When the central key I is in the open state a logic 0 is present at the two inputs S and R of the flip-flop 11. The flip-flop 11 is therefore reset, which causes a logic 1 to appear at the output 110 and a logic 0 at the output 111. A logic 0 supplied from the alarm input a(1) is applied to one input of the AND-gate 12 and a logic 1 supplied from the output 110 is applied to the other input so that a logic 0 is produced at the output of the AND-gate 12. When key T is in the open state and there is no alarm signal on the alarm input a(1), a logic 0 is applied to the two inputs of the AND-gate 10, so that a logic 0 occurs at the output of this gate. In that case, a logic 0 is applied to the two inputs of the OR-gate 13, so that a logic 0 occurs at the output of this OR-gate 13. This results in the indication lamp 1 not being lit. The structure of the alarm units II and III is identical to the structure of the alarm unit I. In the no-alarm state, the indication lamps 2 and n will not be ignited. Logic 0's, which are forwarded to a corresponding number of inputs of OR-gate 17, are present at the outputs 100, 200 and 300 of the alarm units I, II and III, respectively, in the no-alarm state. As a result, a logic 0 will be produced at the output of the OR-gate 17. This logic 0 is applied to the input 60 of the indication arrangement VI, resulting in the indication lamp connected to this input is not lit. In addition, this logic 0 is passed to an input of the AND-gate 23. Logic 0's which are forwarded to a corresponding number of inputs of the OR-gate 18, are present in the no-alarm state at the outputs 101, 201 and 301 of the alarm units I, II and III, respectively. As a result, a logic 0 will be produced at the output of this OR-gate 18. This logic 0 is applied to the input 70 of the alarm inhibitor indication arrangement VII, as a result of which the indication lamp connected to this input will not be lit. In the no-alarm state, logic 0's are present at all the inputs of the OR-gate 14, so that a logic 0 appears at the output of this OR-gate 14. In the no-alarm state, logic 0's are present at all the inputs of the majority gate 15, so that a logic 0 appears at the output of this gate 15. Logic 0's are then present at the inputs of the AND-gate 16, so that a logic 0 is produced at the output of the AND-gate 16, as a result of which the indication lamp in the arrangement V, which is connected to the input 50, will not be lit. A logic 0 is also applied to the input 51 of the arrangement V so that the indication lamp connected to this input will not be lit. In the no-alarm state, a logic 0 is present at the reset input R and at the set input S of the flip-flop 22, so that a logic 1 appears at the output 220 and a logic 0 at the output 221. A logic 0 is present at one input of the AND-gate 20 and a logic 1 at the other input, so that a logic 0 is produced at the output of this AND-gate 20. A logic 0 is present at both inputs of the AND-gate 23, so that a logic 0 is produced at the output of this gate. This logic 0 is applied to the input of the OR-gate 21 and also to the input 52 of the arrangement V. As a result, the indication lamp connected to the input 52 will not be lit. A logic 0 is also applied to the other input of the OR-gate 21, so that at the output of this OR-gate a logic 0 is produced which is applied to the input 61 of the indication arrangement VI. As a result, the indication lamp connected to the input 61 will not be lit.

Figure 2:
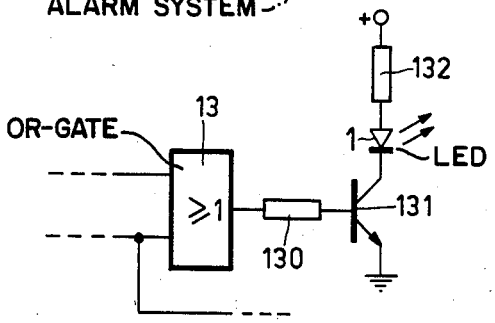
FIG. 2 shows a detail of the supervising arrangement shown in FIG. 1.

FIG. 2 shows in greater detail how the indication lamps are controlled. A light-emitting diode 1 (LED) is, for example, included in the collector circuit of a transistor 131. The emitter of the transistor 131 is connected to ground. The base of the transistor 131 is connected to the output of, for example, the OR-gate 13 via a resistor 130. When, at the output of the OR-gate 13, a logic 0 is present, which, for example, corresponds to ground potential, the transistor 131 will not conduct, so that the diode 1 will not be lit. When a logic 1 is present at the output of the OR-gate 13, which corresponds for example, to a positive voltage which exceeds the base-emitter threshold voltage of the transistor 131, the transistor 131 will start conducting, causing the diode 1 to become lit.

Let it now be assumed that an alarm signal (=logic 1) is received at the alarm input a(1) of the supervising arrangement of FIG. 1. A logic 1 will now appear at the output of the OR-gate 14, as now a logic 1 occurs at one of the inputs of this OR-gate. The output state of the majority gate 15 will not change, since a logic 1 is only applied to one input. A logic 1 will now appear at the output of the AND-gate 16, in response to which, in the arrangement V, the indication lamp connected to the input 50 will be lit. In the alarm unit I, the output state will only change at the outputs of the gates 12 and 13. A logic 1 appears at the output of the AND-gate 12 as now a logic 1 is applied to both inputs of this AND-gate. A logic 1 appears at the output of the OR-gate 13, because a logic 1 is applied to one of its inputs. In response thereto the indication lamp 1 will be lit. A logic 1 will appear at the output of the OR-gate 17 as now a logic 1 is applied to that input of this OR-gate which is connected to the output 100 of the alarm unit I. The indication lamp of the arrangement VI which is connected to the input 60, will now be lit.

When the central key T is in a depressed state (operated), a logic 1 will appear at the contact T(0). This results in the flip-flop 11 being set, as a result of which a logic 0 appears at the output 110 and a logic 1 at the output 111. A logic 0 now appears at the output of the AND-gate 12. A logic 0 is now applied to all the inputs of the OR-gate 17, so that a logic 0 appears at the output of this OR-gate. The indication lamp of the arrangement VI which is connected to the input 60, will consequently go dark. A logic 1 is applied to the input of the OR-gate 18 which is connected to the output 101, so that a logic 1 appears at the output of this OR-gate. The indication lamp in the alarm inhibitor indication arrangement VII which is connected to the input 70, will be lit. A logic 1 is now also applied to the two inputs of the AND-gate 10, so that the lamp 1 will remain lit by the logic 1 from the OR-gate 13.

After the central key has been released, a logic 0 will again appear at the contact T(0), causing only the logic state at the output of the AND-gate 10 to change. There now appears a logic 0 at the output of the AND-gate 10, which results in the indication lamp 1 being switched-off via the OR-gate 13.

If now a second alarm signal (=logic 1) is additionally received at the input a(2), the lamp 2 in the alarm unit II will be lit. In addition, a logic 1 is present at the output 200 and a logic 0 at the output 201. A logic 1 is present at the output of the OR-gate 17, causing the lamp of the arrangement VI which is connected to the input 60, to be lit again. A logic 1 is now applied to two inputs of the majority gate 15, so that now a logic 1 appears at the output of this gate. In response thereto a logic 0 will appear at the output of the AND-gate 16, as a result of which the lamp connected to the input 50 of the arrangement V will go dark. The lamp connected to the input 51 will be lit, which is an indication to personnel observing the arrangement V that there is more than one alarm. A logic 1 is now applied to the two inputs of the AND-gate 20, so that via the OR-gate 21, the lamp connected to the input 61 of the arrangement VI will be lit.

If now the central key T is operated again, a logic 1 will appear at the contact T(0). As a result thereof the flip-flop included in the alarm unit II is set, in response to which a logic 0 appears at the output 200 and a logic 1 at the output 201. The indication lamp in the arrangement VI which is connected to the input 60, will then go dark and the lamp in the alarm inhibitor arrangement VI which is connected to the input 70, will remain lit. In addition, the lamp 2 of the alarm unit II will remain lit. Moreover, the flip-flop 22 will be set, in response to which a logic 0 will occur at the output 220 and a logic 1 at the output 221. As a result thereof, the indication lamp of the arrangement VI which is connected to the input 61, will go dark because the gates 20 and 21 both produce a logic 0.

After the central key T has been released a logic 0 will again appear at the contact T(0), in response to which the lamp 2 of the alarm unit II will go dark.

If now a third alarm signal (=logic 1) enters the input a(n) the lamp n will be lit in the alarm unit III. In addition, a logic 1 is present at the output 300 and a logic 0 at the output 301. In this case, there is a logic 1 at the output of the gate 17, in response to which the lamp of the arrangement VI which is connected to the input 60, will be lit again. In addition, a logic 1 is applied to the two inputs of the AND-gate 23, so that a logic 1 occurs at the output of this AND-gate. As a result, the lamp of the arrangement V which is connected to the input 52, will be lit, which is an indication to the personnel observing this arrangement that there are more than two alarms. Furthermore, the lamp of the arrangement VI which is connected to the input 61, is lit again via the OR-gate 21.

After the key T has been operated and released, only the lamp of the arrangement V which is connected to the input 51, and the lamp of the arrangement VII will remain lit. All the other indication lamps go dark.

From the above description of the operation of the supervising arrangement in accordance with the invention, it will be apparent that personnel observing the arrangement V can at all times check which alarm was added last. Thus, no separate logging unit is required for this check.

The indication lamp of the arrangement VII will remain lit until all the suppressed alarms have been eliminated. This indication lamp may, for example, be provided on the equipment rack which is supervised by the alarm system. It is then readily possible to check where alarms are still suppressed, in that when the central key of a rack where alarms have been suppressed, is operated, it can be seen at a glance which alarms are still in existence, because the individual indication lamps 1 . . . n in the alarm units are re-lit when the appertaining alarm signal is still present.

The indication lamp of the station indication arrangement VI is provided in a suitable position in the station. Alternatively, or additionally, an acoustic alarm (bell) may be provided.

What is claimed is:

1. A supervising arrangement for equipment in a station, the arrangement comprising an alarm system which is responsive to alarm signals occurring in the equipment, different alarm signals from different respective apparatus applied to respective alarm signal inputs of the arrangement being displayed by means of respective indication lamps for each of the possible alarm signals, and energizing circuits for the indication lamps being controllable by means of a central key with which also, after reception of an alarm signal, the alarm system can be released for the reception of a subsequent alarm signal, characterized in that the alarm system comprises switching means for extinguishing, after the operating and releasing of the central key, all indication lamps which are lit and, when the central key is operated again, for re-lighting those indication lamps which correspond to subsisting alarm signals during the period of time the central key (T) remains operated.

2. A supervising arrangement as claimed in claim 1, characterized in that the switching means comprises, in respect of each indication lamp, a set-reset flip-flop having a set input connected to the central key and a reset input connected to the respective alarm input of the arrangement, a first AND-gate having an input connected to an output of the flip-flop and a further input connected to the alarm input, a second AND-gate having an input connected to the central key and a further input connected to said alarm input, and an OR-gate having two inputs connected respectively to the outputs of said first and second AND-gates and an output coupled to the indication lamp.

3. A supervising arrangement as claimed in claim 2, characterized in that the output of the OR-gate is connected via a resistor to the base of a transistor, the collector circuit of which includes a light-emitting diode.

4. A supervising arrangement as claimed in claim 2, characterized in that the output of the first AND-gate is also connected to a station indication arrangement via an OR-gate, another output of the flip-flop being connected to an indication arrangement for alarm inhibition via another OR-gate.

5. A supervising arrangement as claimed in claim 3, characterized in that the output of the first AND-gate is also connected to a station indication arrangement via an OR-gate, another output of the flip-flop being connected to an indication arrangement for alarm inhibition via another OR-gate.

* * * * *